US011820958B2

(12) United States Patent
Champagne et al.

(10) Patent No.: US 11,820,958 B2
(45) **Date of Patent: *Nov. 21, 2023**

(54) USE OF A DIESTER TO IMPROVE THE ANTI-WEAR PROPERTIES OF A LUBRICANT COMPOSITION

(71) Applicant: TotalEnergies OneTech, Courbevoie (FR)

(72) Inventors: Nicolas Champagne, Caluire et Cuire (FR); Gaël Robineau, Lyons (FR)

(73) Assignee: TotalEnergies OneTech, Courbevoie (FR)

( * ) Notice: Subject to any disclaimer, the term of this patent is extended or adjusted under 35 U.S.C. 154(b) by 0 days.

This patent is subject to a terminal disclaimer.

(21) Appl. No.: 17/291,118

(22) PCT Filed: Nov. 4, 2019

(86) PCT No.: PCT/EP2019/080044

§ 371 (c)(1),
(2) Date: May 4, 2021

(87) PCT Pub. No.: WO2020/094546

PCT Pub. Date: May 14, 2020

(65) Prior Publication Data

US 2021/0380898 A1 Dec. 9, 2021

(30) Foreign Application Priority Data

Nov. 5, 2018 (FR) ..... 1860151

(51) Int. Cl.

| | |
|---|---|
| ***C10M 169/04*** | (2006.01) |
| ***C10M 129/74*** | (2006.01) |
| ***C10M 141/10*** | (2006.01) |
| ***C10N 30/06*** | (2006.01) |
| ***C10N 40/25*** | (2006.01) |
| ***C10N 30/02*** | (2006.01) |

(52) U.S. Cl.
CPC ..... *C10M 169/04* (2013.01); *C10M 129/74* (2013.01); *C10M 141/10* (2013.01); *C10M 2203/003* (2013.01); *C10M 2205/0285* (2013.01); *C10M 2207/283* (2013.01); *C10M 2209/084* (2013.01); *C10M 2223/045* (2013.01); *C10N 2030/02* (2013.01); *C10N 2030/06* (2013.01); *C10N 2040/25* (2013.01)

(58) Field of Classification Search
CPC ..... C10M 129/74; C10M 141/10; C10M 169/04; C10M 2203/003; C10M 2205/0285; C10M 2207/283; C10M 2209/084; C10M 2223/045; C10N 2030/02
See application file for complete search history.

(56) References Cited

U.S. PATENT DOCUMENTS

| | | | | |
|---|---|---|---|---|
| 3,003,968 | A | 10/1961 | Bruce et al. | |
| 10,336,961 | B2 | 7/2019 | Nakada et al. | |
| 10,982,169 | B2 | 4/2021 | Broutin et al. | |
| 11,162,047 | B2 | 11/2021 | Champagne et al. | |
| 2006/0120642 | A1* | 6/2006 | Hirata | F16C 33/109 384/100 |
| 2011/0034358 | A1 | 2/2011 | Komatsubara | |
| 2012/0053100 | A1* | 3/2012 | Radano | C10M 169/041 508/474 |
| 2012/0264661 | A1 | 10/2012 | Tsubouchi | |
| 2012/0283162 | A1 | 11/2012 | Tsubouchi | |
| 2013/0005622 | A1* | 1/2013 | Lyon | C10M 171/02 508/192 |
| 2014/0274840 | A1* | 9/2014 | Esche | C10M 159/18 508/362 |
| 2016/0289591 | A1* | 10/2016 | Fujiwara | C10M 169/041 |
| 2017/0022441 | A1* | 1/2017 | Onodera | C10M 141/12 |
| 2018/0100115 | A1 | 4/2018 | Gao et al. | |
| 2018/0100119 | A1 | 4/2018 | Aoyama | |
| 2018/0245014 | A1* | 8/2018 | Nakada | C08F 220/14 |
| 2018/0258365 | A1* | 9/2018 | Ohkubo | C10M 169/048 |
| 2019/0078036 | A1 | 3/2019 | Broutin et al. | |
| 2019/0249102 | A1 | 8/2019 | Martin et al. | |
| 2021/0139805 | A1 | 5/2021 | Champagne | |

FOREIGN PATENT DOCUMENTS

| | | | | |
|---|---|---|---|---|
| EP | 1520904 | A1 | 4/2005 | |
| EP | 3385358 | A1 | 6/2020 | |
| JP | 2012-184360 | A | 9/2012 | |
| WO | 2011/113851 | A1 | 9/2011 | |
| WO | 2015/116496 | A1 | 8/2015 | |
| WO | WO-2016152463 | A1 * | 9/2016 | C08F 220/14 |
| WO | 2017/157979 | A1 | 3/2017 | |
| WO | 2017/157892 | A1 | 9/2017 | |

(Continued)

OTHER PUBLICATIONS

International Search Report received from the European Patent Office in International Application No. dated Jan. 15, 2020.
Written Opinion of the International Search Authority in International Application No. PCT/EP2019/080044 dated Nov. 4, 2019.
International Search Report received from the European Patent Office in International Application No. PCT/ EP2019/067721, dated Aug. 23, 2019.
Written Opinion of the International Search Report received from the European Patent Office in International Application No. PCT/ EP2019/067721, dated Aug. 23, 2019.

(Continued)

*Primary Examiner* — James C Goloboy
(74) *Attorney, Agent, or Firm* — THE MARBURY LAW GROUP, PLLC

(57) ABSTRACT

The present invention relates to the use of a diester of the following formula (I):

$$R^a—C(O)—O—([C(R)_2]_n—O)_s—C(O)—R^b \quad (I),$$

as an additive to improve the anti-wear properties of a lubricant composition comprising one or more anti-wear additive(s).

16 Claims, No Drawings

(56) References Cited

FOREIGN PATENT DOCUMENTS

| | | | |
|---|---|---|---|
| WO | 2018/078290 | A1 | 5/2018 |
| WO | 2019/025446 | A1 | 2/2019 |
| WO | 2020/007853 | A1 | 1/2020 |

OTHER PUBLICATIONS

Non-Final Office Action for copending U.S. Appl. No. 17/256,693, dated Oct. 13, 2021.
Final Office Action for copending U.S. Appl. No. 17/256,693, dated Mar. 14, 2022.

* cited by examiner

USE OF A DIESTER TO IMPROVE THE ANTI-WEAR PROPERTIES OF A LUBRICANT COMPOSITION

CROSS REFERENCE TO RELATED APPLICATION

This is a national stage application of PCT/EP2019/080044, filed internationally on Nov. 4, 2019, which claims priority to French Application No. 1860151, filed on Nov. 5, 2018, which is incorporated by reference herein in its entirety.

The present invention relates to the field of lubricant compositions, in particular lubricant compositions for vehicle engines, in particular for motor vehicle engines. It relates more particularly to the use of new compounds of the diester type as additives in these lubricant compositions, in order to improve their antiwear properties, while advantageously reducing the content of antiwear additives that they comprise.

Lubricant compositions, also called "lubricants", are commonly employed in engines with the main aim of reducing the forces of friction between the various moving metallic components in engines. They are in addition effective for preventing premature wear or even damage of these components, and in particular of their surface.

For this purpose, a lubricant composition is made up conventionally of a base oil, which is generally combined with several additives specifically for enhancing the lubricating performance of the base oil, for example such as friction modifying additives, but also for providing additional performance.

In particular, so-called "antiwear" additives are considered in order to reduce the wear of the mechanical components of the engine, and thus prevent degradation of the durability of the engine. Among these antiwear additives, we may mention in particular the amine phosphates, or also the thiophosphate additives, such as the metal alkylthiophosphates, in particular the zinc alkylthiophosphates, and more specifically the zinc dialkyldithiophosphates or ZnDTP. Such compounds are preferably of the formula $Zn(SP(S)(OR')(OR''))_2$, in which R' and R'', which may be identical or different, represent independently an alkyl group, preferably an alkyl group comprising from 1 to 18 carbon atoms.

Alternative antiwear additives, of the amine tungstate or amine phosphate type, or else zinc-based complexes of a specific formula, have also been described, in combination with polyalkylene glycols, in the applications WO 2017/157892 and WO 2017/157979.

Unfortunately, it is undesirable for these phosphorus-based and/or sulfur-based additives, which generate ash, to be used in engine lubricants, to meet the specifications in terms of "low ash levels" (LOW SAPS). These specifications, elaborated by the European Automobile Manufacturers Association (ACEA), impose maximum contents of sulfated ash (generated by the presence of metals), sulfur and phosphorus, for lubricant compositions, hence the designation "Low SAPS" (Low Sulfated Ash, Phosphorus and Sulfur).

In fact, sulfur, phosphorus and sulfated ash may damage the post-treatment systems installed on vehicles. Ash is harmful to the particle filters, and phosphorus acts as a poison of the catalytic systems.

Lowering the levels of ash, sulfur and phosphorus in engine lubricants, while maintaining the high performance levels required, is still a challenge, as these elements are present in the most commonly used additives.

In particular, it would be desirable to be able to lower the level of antiwear TO additives in a lubricant, for the purpose of complying with the maximum contents imposed for the "Low SAPS" lubricants, while maintaining, or even improving the antiwear properties of the lubricant, which are essential for preventing premature engine degradation.

The aim of the invention is precisely to propose new compounds as additives for improving the antiwear properties of a lubricant composition, in particular intended for an engine, and more particularly a motor vehicle engine, comprising one or more conventional antiwear additives.

Thus, the present invention relates to the use of a diester of the following formula.

$$R^a—C(O)—O—([C(R)_2]_n—O)_s—C(O)—R^b \quad (I)$$

in which:

R represent, independently of one another, a hydrogen atom or a linear or branched $(C_1\text{-}C_5)$alkyl group, in particular a methyl, ethyl or propyl group, in particular methyl;

s has a value of 1 or 2;

n has a value of 1, 2 or 3; it being understood that when s is different from 1, n may be identical or different; and $R^a$ and $R^b$, which may be identical or different, represent independently of one another, hydrocarbon-containing groups, saturated or unsaturated, linear or branched, having a linear chain of 2 to 11 carbon atoms, preferably 3 to 8 carbon atoms;

provided that, when s has a value of 2 and n, which are identical, have a value of 2, at least one of the groups R represents a linear or branched $(C_1\text{-}C_5)$alkyl group; and provided that, when s has a value of 1 and n has a value of 3, at least one of the groups R bound to the carbon in the beta position of the oxygen atoms of the ester functions represents a hydrogen atom, as an additive for improving the antiwear properties of a lubricant composition comprising one or more antiwear additives.

As illustrated in the examples given hereunder, the inventors have found that the addition of said diesters of formula (I) to a lubricant composition comprising one or more antiwear additives used conventionally, such as ZnDTP, makes it possible to obtain antiwear properties that are significantly improved compared to those obtained with a lubricant composition employing only one or more antiwear additives.

The antiwear properties of a composition may more particularly be evaluated according to standard ASTM D2670.

Consequently it is possible, advantageously, to produce, by employing one or more diesters of formula (I) according to the invention, a lubricant composition that has excellent antiwear properties, or even improved antiwear properties, while using smaller amounts of antiwear additives, relative to a conventional lubricant composition not comprising a di ester according to the invention.

By using one or more diesters of formula (I) it is thus possible to lower the content of conventional antiwear additives, and in particular of additives that generate ash, phosphorus or sulfur, while maintaining excellent performance in terms of antiwear properties. Lowering the content of antiwear additives makes it possible, advantageously, to meet the specifications of the "LOW SAPS" lubricant compositions.

Other features, variants and advantages of the application of the diesters of formula (I) will become clearer on reading the following description and examples, given for purposes of illustration, and not limiting the invention.

Hereinafter, the expressions "between . . . and . . . ", "from . . . to . . . " and "varying from . . . to" are equivalent and are intended to signify that the limits are included, unless stated otherwise.

Diester of Formula (I)

As stated above, the additive used according to the invention is a diester or a mixture of diesters of the following general formula (I):

$$R^a—C(O)—O—([C(R)_2]_n—O)_s—C(O)—R^b \quad (I)$$

in which:

R represent, independently of one another, a hydrogen atom or a linear or branched $C_1$-$C_5$) alkyl group, in particular a methyl, ethyl or propyl group, in particular methyl;

s has a value of 1 or 2;

n has a value of 1, 2 or 3; in particular n has a value of 2 or 3 and more particularly n has a value of 2, it being understood that when s is different from 1, n may be identical or different; and $R^a$ and $R^b$, which may be identical or different, represent independently of one another, hydrocarbon-containing groups, saturated or unsaturated, linear or branched, having a linear chain of 2 to 11 carbon atoms, preferably 3 to 8 carbon atoms; provided that, when s has a value of 2, and n, which are identical, have a value of 2, at least one of the groups R represents a linear or branched ($C_1$-$C_5$)alkyl group; and provided that, when s has a value of 1 and n has a value of 3, at least one of the groups R bound to the carbon in the beta position of the oxygen atoms of the ester functions represents a hydrogen atom.

According to one embodiment, $R^a$ and $R^b$, which may be identical or different, represent independently of one another, hydrocarbon-containing groups, saturated or unsaturated, linear or branched, comprising from 2 to 11 carbon atoms, preferably from 3 to 8 carbon atoms.

A diester of formula (I), used according to the invention, will be denoted more simply hereinafter as diester of the invention.

Preferably, in the context of the invention:

"$C_{t-z}$" where t and z are integers, means a carbon chain that may have from t to z carbon atoms; for example $C_{1-4}$ means a carbon chain that may have from 1 to 4 carbon atoms;

"alkyl" means a saturated, linear or branched aliphatic group; for example a $C_{1-4}$-alkyl group represents a carbon chain of 1 to 4 carbon atoms, linear or branched, more particularly a methyl, ethyl, propyl, isopropyl, butyl, isobutyl, tert-butyl.

Preferably, in the aforementioned formula (I), when s is different from 1, all the n are identical.

In particular, n in the aforementioned formula (I) has a value of 2 or 3, and more particularly n has a value of 2.

Preferably, at least one of the groups R represents a ($C_1$-$C_5$)alkyl group, in particular ($C_1$-$C_4$)alkyl, linear or branched, more preferably methyl, ethyl or propyl; advantageously methyl.

According to a particularly preferred embodiment, the diester formula (I) used according to the invention may more particularly be a diester of the following formula (I'):

$$R^a—C(O)—O—([C(R)_2]_n—O)—([C(R')_2]_m—O)_{s-1}—C(O)—R^b \quad (I')$$

in which:

R and R' represent, independently of one another, a hydrogen atom or a linear or branched ($C_1$-$C_5$)alkyl group, in particular a methyl, ethyl or propyl group, in particular a methyl group;

s has a value of 1 or 2;

n has a value of 2;

m has a value of 2;

$R^a$ and $R^b$, which may be identical or different, represent independently of one another, hydrocarbon-containing groups, saturated or unsaturated, linear or branched, having a linear chain of 2 to 11 carbon atoms, preferably 3 to 8 carbon atoms; provided that, when s has a value of 2, at least one of the groups R or R' represents a linear or branched ($C_1$-$C_5$)alkyl group.

Preferably, a diester used according to the invention is of formula (I') in which at least one of the R or R' represents a ($C_1$-$C_5$)alkyl group, in particular ($C_1$-$C_4$)alkyl, linear or branched, more preferably methyl, ethyl or propyl, advantageously methyl.

According to an embodiment variant, s in the aforementioned formula (I) or (I') has a value of 2.

In particular, the diester used according to the invention may be of the following formula (I'a):

$$R^a—C(O)—O—([C(R)_2]_n—O)—([C(R')_2]_m—O)—C(O)—R^b \quad (I'a)$$

in which:

R and R' represent, independently of one another, a hydrogen atom or a linear or branched ($C_1$-$C_5$)alkyl group, in particular a methyl, ethyl or propyl group, advantageously methyl;

n has a value of 2;

m has a value of 2;

$R^a$ and $R^b$, which may be identical or different, represent independently of one another, hydrocarbon-containing groups, saturated or unsaturated, linear or branched, having a linear chain of 2 to 11 carbon atoms, preferably 3 to 8 carbon atoms; provided that at least one of the groups R or W represents a linear or branched ($C_1$-$C_5$)alkyl group, in particular methyl, ethyl or propyl, advantageously methyl.

Preferably, at least one of the groups R represents a linear or branched ($C_1$-$C_5$)alkyl group, in particular a methyl, ethyl or propyl group, advantageously methyl; and at least one of the R' represents a linear or branched ($C_1$-$C_5$)alkyl group, in particular a methyl, ethyl or propyl group, advantageously methyl.

Even more preferably, the diester used according to the invention may be of formula (I'a) in which one of the groups R represents a linear or branched ($C_1$-$C_5$)alkyl group, in particular a methyl, ethyl or propyl group, advantageously methyl; and one of the groups R' represents a linear or branched ($C_1$-$C_5$)alkyl group, in particular a methyl, ethyl or propyl group, advantageously methyl; the other groups R and R' representing hydrogen atoms.

In other words, according to a particular embodiment, the diester used according to the invention may be of the following formula (I"a):

$$R^a—C(O)—O—CHR^1—CHR^2—O—CHR^3—CHR^4—O—C(O)—R^b \quad (I"a)$$

in which:

one of the groups $R^1$ and $R^2$ represents a linear or branched ($C_1$-$C_5$)alkyl group, the other representing a hydrogen atom;

one of the groups $R^3$ and $R^4$ represents a linear or branched $C_1$-$C_5$)alkyl group, the other representing a hydrogen atom; and $R^a$ and $R^b$, which may be identical or different, are as defined above.

In particular, the di ester used according to the invention may be of formula (I"a) which:

one of the groups $R^1$ and $R^2$ represents a methyl, ethyl or propyl group, advantageously methyl, the other representing a hydrogen atom; and one of the groups $R^3$ and $R^4$ represents a methyl, ethyl or propyl group, advantageously methyl, the other representing a hydrogen atom.

According to another embodiment variant, s in the aforementioned formula (I) or (I') has a value of 1.

In other words, the diester used according to the invention may be of the following formula (I'b):

$$R^a—C(O)—O—([C(R)_2]_n—O)—C(O)—R^b \quad (I'b)$$

in which:

R represent, independently of one another, a hydrogen atom or a linear or branched ($C_1$-$C_5$)alkyl group, in particular a methyl, ethyl or propyl group, advantageously methyl;

n has a value of 2;

$R^a$ and $R^b$, which may be identical or different, represent independently of one another, hydrocarbon-containing groups, saturated or unsaturated, linear or branched, having a linear chain of 2 to 11 carbon atoms, preferably 3 to 8 carbon atoms.

Preferably, in the aforementioned formula (I'b), at least one of the R represents a linear or branched ($C_1$-$C_5$)alkyl group, in particular a methyl, ethyl or propyl group, advantageously methyl.

In particular, the diester used according to the invention may be of formula (I'b) in which one of the groups R represents a linear or branched ($C_1$-$C_5$)alkyl group, in particular a methyl, ethyl or propyl group, advantageously methyl, the other representing hydrogen atoms.

As stated above, $R^a$ and $R^b$ in the aforementioned formula (I), (I'), (I'a), (I"a) or (I'b), which may be identical or different, represent hydrocarbon-containing groups, saturated or unsaturated, linear or branched, having a linear chain of 2 to 11 carbon atoms, preferably 3 to 8 carbon atoms.

"Hydrocarbon-containing" group means any group having a carbon atom attached directly to the rest of the molecule and having mainly an aliphatic hydrocarbon character.

Preferably, $R^a$ and $R^b$ in the aforementioned formula (I), (I), (I"a) or (I'b) have a linear chain of 3 to 6 carbon atoms.

According to an embodiment variant, $R^a$ and $R^b$ in the aforementioned formula (I), (I'), (I'a), (I"a) or (I'b) have a linear chain of 8 to 11 carbon atoms.

"Linear chain oft to z carbon atoms" means a saturated or unsaturated, preferably saturated, carbon chain comprising from t to z carbon atoms one after another, the carbon atoms that are optionally present at the level of the branchings of the carbon chain not being taken into account in the number of carbon atoms (t-z) making up the linear chain.

According to a particular embodiment, in the aforementioned formula (I), (I'), (I'a), (I"a) or (I'b), $R^a$ and $R^b$, which may be identical or different, are of vegetable, animal or petroleum According to a particular embodiment, in the aforementioned formula (I), (I'), (I'a), (I"a) or (I' b), $R^a$ and $R^b$, which may be identical or different, represent saturated groups.

According to another particularly preferred embodiment, in the aforementioned formula (I), (I'), (I'a), (I"a) or (I'b), $R^a$ and $R^b$, which may be identical or different, represent linear groups.

According to another particular embodiment, in the aforementioned formula (I), (I'), (I'a), (I"a) or (I'b), $R^a$ and $R^b$ represent saturated $C_8$ to $C_{11}$, in particular $C_8$ to $C_{10}$, linear hydrocarbon-containing groups.

In particular, $R^a$ and $R^b$ are identical.

Preferably, $R^a$ and $R^b$ both represent n-octyl or n-undecyl groups, preferably n-octyl.

According to another particular embodiment, in the aforementioned formula (I), (I'), (I'a), (I"a) or (I'b), $R^a$ and $R^b$ represent branched hydrocarbon-containing groups comprising from 2 to 11 carbon atoms, preferably from 3 to 8 carbon atoms.

The diesters of formula (I) used according to the invention may be commercially available or may be prepared according to methods of synthesis described in the literature and known by a person skilled in the art. These methods of synthesis more particularly employ an esterification reaction between a diol compound of formula $HO—([C(R)_2]_n—O)_s—OH$ and compounds of formula $R^a$—COOH and $R^b$—COOH, with $R^a$ and $R^b$, which may be identical or different, being as defined above.

Of course, it is up to a person skilled in the art to adjust the synthesis conditions to obtain the diesters required according to the invention.

As examples, diesters of the aforementioned formula (I), in particular of the aforementioned formula (I'), may be obtained by an esterification reaction between a mono- or polypropylene glycol, in particular monopropylene glycol (MPG) or dipropylene glycol (DPG), and one or more suitable carboxylic acids $R^a$—COOH and $R^b$—COOH.

As an example, a diester or a mixture of diesters of formula (I') as defined above, where:

s has a value of 2, one of the groups R representing a linear or branched ($C_1$-$C_5$)alkyl group, in particular a methyl, ethyl or propyl group, advantageously methyl, the other representing hydrogen atoms; and one of the groups R' representing a linear or branched ($C_1$-$C_5$)alkyl group, in particular a methyl, ethyl or propyl group, advantageously methyl, the other representing hydrogen atoms, may be obtained via an esterification reaction between dipropylene glycol (DPG) and one or more suitable carboxylic acids $R^a$—COOH and $R^b$—COOH.

A diester of formula (I') as defined above, where s has a value of 1, one of the groups R representing a linear or branched ($C_1$-$C_5$)alkyl group, in particular a methyl, ethyl or propyl group, advantageously methyl, the other representing hydrogen atoms, may be obtained via an esterification reaction between monopropylene glycol (MPG) and one or more suitable carboxylic acids $R^a$—COOH and $R^b$—COOH.

In particular, in the case when $R^a$ and $R^b$ both represent n-octyl or n-undecyl groups, said diester or mixture of diesters may thus be obtained by an esterification reaction between monopropylene glycol or dipropylene glycol and nonanoic acid or dodecanoic acid.

It is understood in the context of the present invention that the diester of formula. (I) as defined above may be in the form of a mixture of diesters of formula (I) as defined above.

Application in a Lubricant Composition

The diesters of formula (I) are used as additives in a lubricant composition, in particular in a lubricant composition for an engine, in particular of a vehicle, and more preferably for a motor vehicle engine.

In general, said diester or diesters of formula (I) may be used in a lubricant composition, at a rate from 1 to 30 wt %, in particular from 5 to 30 wt %, in particular from 5 to 25 wt %, preferably from 5 to 20 wt %, relative to the total weight of the lubricant composition.

Antiwear Additives

As stated above, a lubricant composition considered according to the invention comprises one or more conventional antiwear additives.

"Antiwear additive" denotes a compound which, when used in a lubricant composition, in particular a lubricant composition for a vehicle engine, in particular for a motor vehicle engine, makes it possible to improve the antiwear properties of the composition.

There is a great variety of antiwear additives, for example such as polysulfide additives, sulfur-containing olefinic additives or thiophosphate additives such as the metal alkylthiophosphates, in particular the zinc alkylthiophosphates, and more specifically the zinc dialkyldithiophosphates or ZnDTP. The preferred compounds are of formula $Zn((SP(S)(OR)(OR'))_2$, in which R and R', which may be identical or different, represent, independently of one another, linear or branched, preferably branched, alkyl groups preferably comprising from 1 to 18 carbon atoms. Preferably, at least one of the groups R and R' represents an alkyl group, preferably branched, having at least 6 carbon atoms, in particular having from 6 to 18 carbon atoms.

Thus, according to a particular embodiment, the diester or diesters of formula (I) according to the invention are used in a lubricant composition in combination with one or more additives of the zinc dialkyldithiophosphate type, in particular of the aforementioned formula Zn((SP(S)(OR)(OR)).

A lubricant composition considered according to the invention may comprise from 0.01 to 6 wt %, preferably from 0.05 to 4 wt %, more preferably from 0.1 to 2 wt % of antiwear additives, relative to the total weight of the composition.

As mentioned above, the use of one or more diesters of formula (I) according to the invention makes it possible advantageously to improve the anti-wear properties of the lubricant composition. This leads, according to the invention, to the possibility of obtaining a lubricant composition that has excellent antiwear properties, while lowering the content of antiwear additives used conventionally.

Thus, according to a particularly advantageous embodiment variant, the anti wear additive or additives, in particular those that are generators of sulfur or phosphorus, are present in a lubricant composition in a content less than or equal to 2 wt %, in particular less than or equal to 1 wt %.

More particularly, it is possible, advantageously, to lower the content of conventional antiwear additives, such as zinc dialkyldithiophosphates, to meet the "LOW SAPS" specifications required for the lubricant composition.

A lubricant composition typically comprises, besides one or more diesters of formula (I) as defined above, in combination with one or more conventional antiwear additives, one or more base oils, as well as other additives, conventionally considered in lubricant compositions.

In terms of formulation of a lubricant composition of this kind, the diester or diesters of formula (I) may be added to a base oil or a mixture of base oils, and then the other supplementary additives, including the antiwear additive or additives, are added.

Alternatively, said ester or esters of formula (I) may be added to a preexisting conventional lubricant formulation, in particular comprising one or more base oils and supplementary additives, in particular one or more antiwear additives.

For example, a lubricant composition for an engine may be supplemented with one or more diesters of formula (I) according to the invention by adding, for example, said diester or diesters directly in t e reservoir filled beforehand with a conventional lubricant formulation.

Base Oils

A lubricant composition considered according to the invention may thus further comprise one or more base oils different from the diesters of formula (I).

These base oils may be selected from the base oils used conventionally in the field of lubricating oils, such as synthetic or natural mineral oils, animal or vegetable oils or mixtures thereof.

It may be of a mixture of several base oils, for example a mixture of two, three, or four base oils.

The base oils of the lubricant compositions considered according to the invention may in particular be oils of mineral or synthetic origin belonging to groups I to V according to the classes defined in the API classification (or their equivalents according to the ATIEL, classification) and presented in Table A below, or mixtures thereof, provided that they are different from the diesters of the invention.

TABLE A

| | Saturates content | Sulfur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | >120 |
| Group IV | Polyalphaolefins (PAO) | | |
| Group V | Esters and other bases not included in groups I to IV | | |

The mineral base oils include all types of base oils obtained by atmospheric and vacuum distillation of crude oil, followed by refining operations such as solvent extraction, deasphalting, solvent dewaxing, hydrofining, hydrocracking, hydroisomerization and hydrofinishing.

The synthetic base oils may be esters of carboxylic acids and alcohols, polyalphaolefins or else polyalkylene glycol (PAG) obtained by polymerization or copolymerization of alkylene oxides comprising from 2 to 8 carbon atoms, in particular from 2 to 4 carbon atoms. The polyalphaolefins used as base oils are for example obtained from monomers comprising 4 to 32 carbon atoms, for example starting from decene, octene or dodecene, and whose viscosity at 100° C. is between 1.5 and 15 $mm^2.s^{-1}$ according to standard ASTM D445. Their average molecular weight is generally between 250 and 3000 according to standard ASTM D5296.

Mixtures of synthetic and mineral oils, which may be biosourced, may also be used.

Generally there is no limitation with respect to the use of different base oils in the lubricant composition, except that they must have properties, in particular of viscosity, viscosity index, sulfur content or resistance to oxidation, suitable for use for vehicle engines.

Preferably, a lubricant composition considered according to the invention comprises at least one base oil selected from the oils of group II, III and IV of the API classification, and mixtures thereof.

In particular, said lubricant composition may comprise at least one base oil of group III.

A lubricant composition considered according to the invention may comprise at least 50 wt % of base oil(s) relative to its total weight, in particular at least 60 wt % of base oil(s), and more particularly between 60 and 99 wt % of base oil(s).

Preferably, the oil or oils of group III represent at least 50 wt %, in particular at least 60 wt % of the total weight of the base oils of the composition.

Other Additives

A lubricant composition considered according to the invention may also further comprise all types of additives, suitable for use in a lubricant for a vehicle engine, in particular a motor vehicle engine.

These additives may be introduced individually and/or in the form of a mixture like those already on sale for the commercial formulations of lubricants for vehicle engines, with a level of performance as defined by the ACEA (European Automobile Manufacturers Association) and/or the API (American Petroleum Institute), which are familiar to a person skilled in the art.

These additives may in particular be selected from friction modifying additives, extreme pressure additives, detergents, antioxidants, viscosity index (VI) improvers, pour point depressants (PPDs), dispersants, antifoaming agents, thickeners, and mixtures thereof A lubricant composition considered according to the invention may comprise at least one friction modifying additive.

The friction modifying additives may be selected from compounds supplying metallic elements and ash-free compounds.

Among the compounds supplying metallic elements, we may mention complexes of transition metals such as Mo, Sb, Sn, Fe, Cu, Zn whose ligands may be hydrocarbon-containing compounds comprising oxygen, nitrogen, sulfur or phosphorus atoms.

The ash-free friction modifying additives are generally of organic origin and may be selected from the monoesters of fatty acids and polyols, alkoxylated amines, alkoxylated fatty amines, fatty epoxides, borate fatty epoxides, fatty amines or glycerol esters of fatty acid. According to the invention, the fatty compounds comprise at least one hydrocarbon-containing group comprising from 10 to 24 carbon atoms.

According to an advantageous embodiment, a lubricant composition comprises at least one friction modifying additive, in particular molybdenum-based.

In particular, the molybdenum-based compounds may be selected from molybdenum dithiocarbamates (Mo-DTC), molybdenum dithiophosphates (Mo-DTP), and mixtures thereof.

According to a particular embodiment, a lubricant composition comprises at least one Mo-DTC compound and at least one Mo-DTP compound. A lubricant composition may in particular comprise a molybdenum content between 1000 and 2500 ppm.

Advantageously, such a composition makes it possible to achieve additional fuel savings.

Advantageously, a lubricant composition considered according to the invention may comprise from 001 to 5 wt %, preferably from 0.01 to 5 wt %, more particularly from 0.1 to 2 wt % or even more particularly from 0.1 to 1.5 wt %, relative to the total weight of the lubricant composition, of friction modifying additives, including advantageously at least One molybdenum-based friction modifying additive.

A lubricant composition considered according to the invention may comprise at least one antioxidant. The antioxidants are essentially intended to delay the degradation of the lubricant composition in service. This degradation may in particular be reflected in the formation of deposits, by the presence of sludge or by an increase in the viscosity of the lubricant composition. They act in particular as radical inhibitors or destroyers of hydroperoxides.

Among the antioxidants commonly used, we may mention antioxidants of the phenolic type, antioxidants of the amine type, and thiophosphate antioxidants. Some of these antioxidants, for example the thiophosphate antioxidants, may be generators of ash. The phenolic antioxidants may be ash-free or may be in the form of neutral or basic metal salts. The antioxidants may in particular be selected from sterically hindered phenols, sterically hindered phenol esters and sterically hindered phenols comprising a thioether bridge, diphenylamines, diphenylamines substituted with at least one $C_1$-$C_{12}$ alkyl group, N,N'-dialkaryl diamines and mixtures thereof.

Preferably, the sterically hindered phenols are selected from the compounds comprising a phenol group in Which at least one carbon vicinal to the carbon bearing the alcohol function is substituted with at least one $C_1$-$C_{10}$ alkyl group, preferably a $C_1$-$C_6$ alkyl group, preferably a $C_4$ alkyl group, preferably with the tert-butyl group.

The amine compounds are another class of antioxidants that may be used, optionally in combination with the phenolic antioxidants. Examples of amine compounds are the aromatic amines, for example the aromatic amines of formula $NR^5R^6R^7$ in which $R^5$ represents an aliphatic group or an aromatic group, optionally substituted, $R^6$ represents an aromatic group, optionally substituted, $R^7$ represents a hydrogen atom, an alkyl group, an amyl group or a group of formula $R^8S(O)_zR^9$ in which $R^8$ represents an alkylene group or an alkenylene group, $R^9$ represents an alkyl group, an alkenyl group or an aryl group and z represents 0, 1 or 2.

Sulfurized alkyl phenols or their salts of alkali metals and alkaline-earth metals may also be used as antioxidants.

A lubricant composition considered according to the invention may contain all types of antioxidants known by a person skilled in the art. Advantageously, the lubricant composition comprises at least one ash-free antioxidant.

Also advantageously, a lubricant composition considered according to the invention may comprise from 0.1 to 2 wt % of at least one antioxidant, relative to the total weight of the composition.

A lubricant composition considered according to the invention may comprise at least one detergent. The so-called detergents generally make it possible to reduce the formation of deposits on the surface of metal components by dissolving the byproducts of oxidation and combustion.

The detergents are generally known by a person skilled in the art. The detergents may be anionic compounds comprising a long lipophilic hydrocarbon-containing chain and a hydrophilic head. The associated cation may be a metal cation of an alkali metal or alkaline-earth metal.

The detergents are preferably selected from the salts of alkali metals or alkaline-earth metals of carboxylic acids, sulfonates, salicylates, naphthenates, as well as phenolate salts. The alkali metals and alkaline-earth metals are preferably calcium, magnesium, sodium or barium. These metal salts generally comprise the metal in a stoichiometric amount or in excess, i.e. in an amount greater than the stoichiometric amount. They are then overbased detergents; the metal in excess, supplying the overbased character to the detergent, is then generally in the form of a metal salt insoluble in the base oil, for example a carbonate, a hydroxide, an oxalate, an acetate, a glutamate, preferably a carbonate.

The detergents are generally used in a content ranging from 0.5 to 1 wt %, preferably from 0.5 to 4 wt %, relative to the total weight of the lubricant composition.

Advantageously, they are present in a content below 4 wt %, in particular below 2 wt %, in particular below 1 wt %, or the lubricant composition is even free from detergent(s).

A lubricant composition considered according to the invention may comprise at least one pour point depressant (PPD). By slowing down the formation of wax crystals, the pour point depressants generally improve the low-temperature behavior of the lubricant composition.

As examples of agents for reducing the pour point, we may mention alkyl polymethacrylates, polyaciy fates, polyaryl amides, polyalkyl phenols, polyalkyl naphthalenes and alkylated polystyrenes.

A lubricant composition considered according to the invention may also comprise at least one dispersant. The dispersants ensure that the insoluble solid contaminants consisting of the byproducts of oxidation that form when the lubricant composition is in service are kept in suspension and are removed. They may be selected from Mannich bases, succinimides and derivatives thereof.

In particular, a lubricant composition considered according to the invention may comprise from 0.2 to 10 wt % of dispersants), relative to the total weight of the composition.

A lubricant composition considered according to the invention may also comprise at least one viscosity index (VI) improver. The viscosity index (VI) improver, in particular the polymeric viscosity index improvers, make it possible to guarantee good low-temperature durability and a minimum viscosity at high temperature. As examples of polymeric viscosity index improver, we may mention the polymeric esters, the homopolymers or the copolymers, hydrogenated or nonhydrogenated, of styrene, of butadiene and of isoprene, the homopolymers or the copolymers of olefins, such as ethylene or propylene, the polyacrylates and polymethacrylates (PMA).

In particular, a lubricant composition considered according to the invention may comprise from 1 to 15 wt % of viscosity index improvers, relative to the total weight of the lubricant composition.

A lubricant composition considered according to the invention may also comprise at least antifoaming additive. The antifoaming additives may be selected from the polar polymers such as polymethylsiloxanes or polyacrylates.

In particular, a lubricant composition considered according to the invention may comprise from 0.01 to 3 wt % of antifoaming additive(s), relative to the total weight of the lubricant composition.

As mentioned above, the use of one or more diesters of formula (I) required according to the invention as additive makes it possible to improve significantly the antiwear properties of the lubricant composition comprising one or more conventional antiwear additives.

The antiwear properties can be evaluated according to a procedure based on standard ASTM 172670, by using a tribometer, as described in the examples given hereunder.

A lubricant composition considered according to the invention may more particularly be a composition of a grade according to the SAEJ300 classification defined by the formula (X)W(Y), in which X represents 0 or 5 and Y represents an integer from 4 to 30. This grade qualifies a selection of lubricant compositions specially intended for a motor vehicle engine application and which in particular satisfy specific properties quantified with respect to various parameters such as low-temperature viscosity on starting, low-temperature pumpability, kinematic viscosity at low shear rate and dynamic viscosity at high shear rate, The viscosity grade of a lubricant composition considered according to the invention may in particular be selected from:

a grade according to the SAEJ300 classification defined by formulas (II) or (III)

$$0\ W\ (Y) \tag{II}$$

$$5\ W\ (Y) \tag{III}$$

in which Y represents an integer from 4 to 20, in particular from 4 to 16 or from 4 to 12; or a grade according to the SAEJ300 classification defined by formulas (IV) or (V)

$$(X)\ W\ 8 \tag{IV}$$

$$(X)\ W\ 12 \tag{V}$$

in which X represents 0 or 5.

According to a particular embodiment, the grade according to the SAEJ300 classification of a lubricant composition considered according to the invention is selected from 0W4, 0W8, 0W12, 0W16, 0W20, 5W4, 5W8, 5W12, 5W16 and 5W20, and is preferably selected from 0W4, 0W8, 0W12, 0W16, 0W20 and 5W20.

In particular, a lubricant composition considered according to the invention may have a grade according to the SAEJ300 classification of 0W20 or of 0W16.

Advantageously, the kinematic viscosity measured at 100° C. according to standard ASTM D445 of a lubricant composition considered according to the invention is between 3 and 15 $mm^2.s^{-1}$, in particular between 3 and 13 $mm^2.s^{-1}$.

Advantageously, the viscosity measured at high temperature and high shear (HTHS viscosity), measured at 150° C., is greater than or equal to 1.7 mPa·s, preferably between 1,7 and 3.7 mPa·s, advantageously between 2.3 and 3.7 mPa·s.

HTHS measurement is carried out at high shear ($10^6\ s^{-1}$) and at 150° C., according to the standardized methods CEC-L-36-A-90, ASTM D4683 and ASTMD4741.

The invention will now be described with the aid of the following examples, given of course for purposes of illustration, and not limiting the invention.

EXAMPLES

Example 1

Preparation of Lubricant Compositions Comprising a Diester Required According to the Invention and of Comparative Compositions Lubricant compositions according to the invention (I1 and I2), using a diester of formula (I), and comparative compositions ($C_1$ and $C_2$), without a diester of formula (I), were formulated with the components and amounts (expressed in percentage by weight) indicated in Table 1 below.

The lubricant compositions are obtained by simple mixing of the following components at room temperature:

- Base oil of group III (KV100=4.2 $mm^2/s$, KV40=19.1 $mm^2/s$, VI of 126) available commercially for example from the company SK Lubricants under the trade name Yubase® 4,
- Conventional additive package 1 comprising an anti wear additive (zinc bis(dithiophosphate) and bis[O,O-bis(2-ethylhexyl)], for example marketed under the name OLOA® 269R), antioxidants, a friction modifier, a dispersant and detergents,
- Conventional additive package 2 comprising an antiwear additive (zinc bis[O-(1,3-dimethylbutyl)] bis[O-(isopropyl)] bis(dithiophosphate)), antioxidants, a friction modifier, a dispersant and detergents,
- A polymethacrylate comb polymer available commercially from the company Evonik under the trade name Viscoplex® V3-200, and optionally
- A diester of formula (I) according to the invention, obtained by an esterification reaction between dipropylene glycol and at least two nonanoic fatty acids.

TABLE 1

| | Compositions according to the invention | | Comparative compositions | |
|---|---|---|---|---|
| | I1 | I2 | C1 | C2 |
| Additive package 1 | 12.2 | | 12.2 | |
| Additive package 2 | | 12.2 | | 12.2 |
| PMA polymer | 4.7 | 4.7 | 4.7 | 4.7 |
| Base oil | 68.1 | 68.1 | 83.1 | 83.1 |
| Ester of formula (I) of the invention | 15 | 15 | 0 | 0 |

The characteristics of the compositions thus prepared are presented in the following Table 2.

TABLE 2

| Compositions | I1 | I2 | C1 | C2 |
|---|---|---|---|---|
| HTHS(1) | 2.59 | 2.60 | 2.58 | 2.57 |
| KV40 ($mm^2/s$)(2) | 31.14 | 31.07 | 32.32 | 32.09 |
| KV100 ($mm^2/s$)(3) | 7.92 | 7.92 | 7.39 | 7.42 |
| VI(4) | 243 | 244 | 206 | 209 |

(1)high-temperature, high-shear (HTHS) viscosity measurement, at shear of $10^6$ $s^{-1}$ and at 150° C. by the standardized method ASTM D4683;
(2)(3)kinematic viscosity at 40° C. (KV40) and at 100° C. (KV100) measured according to standard ASTM D445-97;
(4)viscosity index (VI), measured according to standard ASTM D2270-93

Example 2

Evaluation of the Antiwear Properties

Method of Evaluation

This evaluation is based on a procedure according to standard ASTM D2670, requiring the use of a FALEX tribometer, in the following test conditions.

test specimens: FALEX steel
grinding time: 300 s;
test duration: 180 min;
grinding load: 445 N;
test load: 1335 N;
speed: 290 rev/min;
room temperature.

The test results are presented in Table 3 below, and are expressed more specifically in uni; the lower the value obtained, the better are the antiwear properties of the composition evaluated.

TABLE 3

| Compositions | I1 | I2 | C1 | C2 |
|---|---|---|---|---|
| Wear (μm) | 24 | 41 | 95 | 97 |
| Pin mass loss vés (mg) | 3 | 18 | 56 | 57 |
| Test end temp. (° C.) | 80 | 103 | 119 | 134 |
| Mean torque at end of test (Ncm) | 40 | 80 | 105 | 109 |

The results show that the addition of a diester of formula (I) according to the invention to the lubricant compositions makes it possible to improve their antiwear properties significantly.

The invention claimed is:

1. A method of improving the anti-wear properties of a lubricant composition comprising one or more anti-wear additives chosen from metal alkylthiophosphates, the method comprising adding to the lubricant composition an amount of a diester sufficient to improve the anti-wear properties of the composition, wherein the diester is represented by the following formula (I):

$$R^a—C(O)—O—([C(R)_2]_n—O)_s—C(O)—R^b \quad (I),$$

wherein:

R represents, independently of one another, a hydrogen atom, or a linear or branched ($C_1$-$C_5$)alkyl group;

s has a value of 1 or 2;

n has a value of 1, 2 or 3, wherein when s is 2, n may be identical or different from s; and $R^a$ and $R^b$ are independently selected from saturated or unsaturated, linear or branched, hydrocarbon-containing groups having a linear chain of 2 to 11 carbon atoms;

with the provisos that:

when s and n both have a value of 2, at least one of the R groups represents a linear or branched ($C_1$-$C_5$) alkyl group; and when s has a value of 1 and n has a value of 3, at least one of the R groups bound to the carbon in the beta position of the oxygen atoms of the ester functions represents a hydrogen atom, wherein the lubricant composition is of a grade according to the SAEJ300 classification defined by the formula (X)W(Y), wherein X represents 0 or 5; and Y represents an integer from 4 to 30, wherein the total amount of metal alkylthiophosphates in the composition ranges from 0.01 wt. % to 6 wt. %, relative to the total weight of the lubricant composition, wherein the total amount of diesters of formula (I) added to the lubricant composition ranges from 1 wt. % to 20 wt. %, relative to the total weight of the lubricant composition, wherein the anti-wear properties of the lubricant composition, evaluated according to a procedure based on standard ASTM D2670, are improved compared to a composition that is otherwise identical except for not comprising a diester of formula (I'), and wherein the lubricant composition comprises at least 50 wt. % of one or more base oils different from the diesters of formula (I).

2. The method of claim 1, wherein the total amount of diesters of formula (I) added to the lubricant composition ranges from 5 wt. % to 20 wt. %, relative to the total weight of the lubricant composition.

3. The method of claim 1, wherein the one or more anti-wear additives are selected from zinc dialkyldithiophosphates represented by the formula:

$$Zn((SP(S)(OR)(OR'))_2,$$

wherein, R and R' are independently selected from linear or branched alkyl groups comprising from 1 to 18 carbon atoms.

4. The method of claim 1, wherein the lubricant composition comprises a total amount of metal alkylthiophosphates ranging from 0.1 wt. % to 2 wt. %, relative to the total weight of the lubricant composition.

5. The method of claim 1, wherein the one or more base oils are oils of group II, Ill, or IV of the API classification.

6. The method of claim 1, wherein the lubricant composition further comprises one or more of friction modifying additives, extreme pressure additives, detergents, antioxidants, viscosity index improvers, pour point depressants, dispersants, antifoaming agents, thickeners, or mixtures thereof.

7. A method of improving the anti-wear properties of a lubricant composition comprising one or more anti-wear additives chosen from metal alkylthiophosphates, the method comprising adding to the lubricant composition an amount of a diester sufficient to improve the anti-wear properties of the composition, wherein the diester is represented by the following formula (I'):

$$R^a—C(O)—O—([C(R)_n—O)—([C(R')_2]_m—O)_{s-1}—C(O)—R^b \quad (I'),$$

wherein:

R and R' are independently selected from a hydrogen atom or a linear or branched ($C_1$-$C_5$)alkyl group;

s has a value of 1 or 2;

n has a value of 2;

m has a value of 2; and $R^a$ and $R^b$ are independently selected from saturated or unsaturated, linear or branched, hydrocarbon-containing groups having a linear chain of 2 to 11 carbon atoms;

with the proviso that when s has a value of 2, at least one of the R or R' groups represents a linear or branched ($C_1$-$C_5$)alkyl group, wherein the total amount of metal alkylthiophosphates in the composition ranges from 0.05 wt. % to 4 wt. %, relative to the total weight of the lubricant composition, and wherein the total amount of diesters of formula (I') added to the lubricant composition ranges from 1 wt. % to 20 wt. %, relative to the total weight of the lubricant composition, wherein the anti-wear properties of the lubricant composition, evaluated according to a procedure based on standard ASTM D2670, are improved compared to a composition that is otherwise identical except for not comprising a diester of formula (r), and wherein the lubricant composition comprises at least 50 wt. % of one or more base oils different from the diesters of formula (I).

8. The method of claim 7, wherein:

s has a value of 2;

one of the R groups represents a linear or branched ($C_1$-$C_5$)alkyl group and the other R group represents a hydrogen atom; and one of the R' groups represents a linear or branched ($C_1$-$C_5$)alkyl group and the other R' group represents a hydrogen atom.

9. The method of claim 7, wherein:

s has a value of 1, and one of the R groups represents a linear or branched ($C_1$-$C_5$)alkyl group and the other R group represents a hydrogen atom.

10. The method of claim 7, wherein the total amount of diesters of formula (I') added to the lubricant composition ranges from 5 wt. % to 20 wt. %, relative to the total weight of the lubricant composition.

11. The method of claim 7, wherein the one or more anti-wear additives are selected from zinc dialkyldithiophosphates represented by the formula:

$$Zn((SP(S)(OR)(OR'))_2,$$

wherein R and R' are independently selected from linear or branched alkyl groups comprising from 1 to 18 carbon atoms.

12. The method of claim 7, wherein the lubricant composition comprises a total amount of metal alkylthiophosphates ranging from 0.1 wt. % to 2 wt. %, relative to the total weight of the lubricant composition.

13. The method of claim 7, wherein the one or more base oils are oils of group II, Ill, or IV of the API classification.

14. The method of claim 7, wherein the lubricant composition is of a grade according to the SAEJ300 classification defined by the formula (X)W(Y), wherein X represents 0 or 5, and Y represents an integer from 4 to 30.

15. The method of claim 7, wherein the lubricant composition further comprises one or more of friction modifying additives, extreme pressure additives, detergents, antioxidants, viscosity index improvers, pour point depressants, dispersants, antifoaming agents, thickeners, or mixtures thereof.

16. The method of claim 1, wherein:

the anti-wear additives comprise zinc dialkyldithiophosphate, and the composition further comprises at least one polymethylacrylate polymer.

* * * * *